US006726022B2

(12) United States Patent
Wikström

(10) Patent No.: US 6,726,022 B2
(45) Date of Patent: Apr. 27, 2004

(54) SCREENING DEVICE AND ROTOR FOR USE IN A SCREENING DEVICE

(75) Inventor: Tomas Wikström, Sundsvall (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 10/182,487

(22) PCT Filed: Jan. 15, 2001

(86) PCT No.: PCT/SE01/00058

§ 371 (c)(1),
(2), (4) Date: Jul. 30, 2002

(87) PCT Pub. No.: WO01/59207

PCT Pub. Date: Aug. 16, 2001

(65) Prior Publication Data

US 2003/0000870 A1 Jan. 2, 2003

(30) Foreign Application Priority Data

Feb. 8, 2000 (SE) ..... 0000414

(51) Int. Cl.[7] ..... B07B 1/04

(52) U.S. Cl. ..... 209/273; 209/281; 209/283; 209/305; 209/306; 210/413; 210/414; 210/415

(58) Field of Search ..... 209/273, 281, 209/283, 305, 306; 210/413, 414, 415

(56) References Cited

U.S. PATENT DOCUMENTS 4,915,822 A * 4/1990 Ljokkoi ..... 209/273
5,176,261 A * 1/1993 Holz ..... 209/273
5,186,332 A * 2/1993 Hatton et al. ..... 210/415 X
5,645,724 A * 7/1997 Lamort ..... 210/415

FOREIGN PATENT DOCUMENTS

| | | |
|---|---|---|
| SE | 464 473 B1 | 4/1991 |
| WO | WO-98/46822 A1 | 10/1998 |
| WO | WO-99/32712 A1 | 7/1999 |

* cited by examiner

*Primary Examiner*—Donald P. Walsh
*Assistant Examiner*—Matthew J. Kohner
(74) *Attorney, Agent, or Firm*—Lerner, David, Littenberg, Krumholz Mentlik, LLP

(57) ABSTRACT

Apparatus for the screening of fiber suspensions is disclosed including a housing, a reject outlet and an accept outlet, a screen located within the housing, a rotor including pulsation wings mounted therein, a reject chamber in the housing for collecting a reject portion of the fiber suspension, and an accept chamber for collecting the accept portion of the fiber suspension passing through the screen and supplying it to the accept outlet, each of the pulsation wings including an outside face and an inside face, a leading edge, a trailing edge, and upper and lower ends so that a predetermined pressure difference is created between the outside and inside faces of the pulsation wings in the direction of the lower edge thereof.

9 Claims, 2 Drawing Sheets

SCREENING DEVICE AND ROTOR FOR USE IN A SCREENING DEVICE

FIELD OF THE INVENTION

The present invention relates to a device for screening fiber suspensions, such as pulp, for dividing the fiber suspension into different length fractions or separating impurities and other fractions of the pulp undesired for the final product, such as coarse particles, undefibered material and poorly worked fibers.

BACKGROUND OF THE INVENTION

It is known that variations in the concentration of a pulp are of decisive importance for the screening process. A decrease in concentration implies an increase of the hydraulic load on the screening means, i.e. the flow rate through the openings in the screening means increases. At concentrations below about 0.5% the total capacity becomes unacceptably low. An increase in the concentration implies instead an increase of the energy intensity required for breaking up the fiber network into individual fibers and make it fluid, i.e., so-called fluidization, which is a prerequisite for the screening process. The concentration, thus, defines a limit for effective utilization of the screen. Too high a concentration results in the flocks of the fiber suspension not being broken up, which implies that the screening process cannot continue.

In a conventional pressurized screen for pulp, the thickening along the length of the screening zone, from the inlet for unscreened pulp to the outlet, the reject chamber, for discharging concentrated impurities, is the physical problem, which limits the efficiency of the screen, with regard to both capacity and efficiency. The thickening means physically that the concentration of the fiber suspension increases from the inlet to the reject outlet along the surface of the screening means. Impurities are also concentrated from the inlet to the reject outlet. Increased concentration implies, that the strength of the fiber network increases considerably.

Since the rotating means of the screen rotates at an equal speed along the entire length of the screening zone, the energy supply is substantially constant from the inject end to the reject end of the screening means. This implies that the screening must start at too low a concentration at the beginning of the screening zone, in order to prevent the pulp concentration from rapidly becoming so high that a large portion of the screening zone acts as a thickener. Too high an energy intensity in relation to the pulp concentration implies, that the fiber suspension at the beginning of the screening zone has an unnecessarily high turbulence level, and thereby has a deteriorated separation selectivity. After a short zone under ideal conditions the pulp concentration is too high, the energy is no longer sufficient to break up the fiber network, and the final portion of the screening zone acts as a thickener. A high degree of thickening can also give rise to a braking effect, due to mechanically transferred force between the screening means and the rotating means. In other words, the thickening implies that the screen loses both efficiency and capacity.

One has succeeded in increasing the pulp concentration in certain modern pulp screens by placing inside the screening means a rotating means with pulsation creating wings, which yield an extended suction pulse, which, in turn, creates a vacuum on the outside of the pulsation wing, i.e. adjacent the screen means, in order to recover through the screening means a certain amount of the liquid which is lost by the thickening end in order to keep the screening means open. At the same time an overpresssure is created on the inside of the pulsation wing. The difference in pressure between the inside and the outside of the pulsation wing results in the rear edge of the wing as seen in the direction of rotation, a flow of pulp from the inside of the pulsation wing to its outside. Extended suction pulses through wide pulsation wings make it possible to increase the concentration in a screen, due to the fact that more liquid can be recovered. The screening means, however, is then subjected to very high loads. Problems can also arise with erosion on the pulsation wings. The stresses become especially high in the final portion of the screening zone, because the concentration of the pulp at that point is the greatest, and the pulp contains a great amount of impurities. Variations in the pulp concentration, dewatering properties or fiber length distribution affect the critical balance between network strength and energy supply. This results in one being forced to operate the screen with higher than optimum speed in order to manage the operability, even at normal process variations.

One object of the present invention is a screening device where the aforesaid problems can be reduced considerably in that the pressure difference between the inside and outside of the pulsation wing is reduced at the end of the screening zone.

SUMMARY OF THE INVENTION

This and other objects can now be realized by forming the pulsation wing at the end of the screening zone, namely at its lower portion, in such a way that its extension in the tangential direction substantially decreases gradually in the direction towards the reject outlet, and particularly where this decrease is created at the rear edge of the pulsation wing.

In accordance with the present invention, these and other objects are thus achieved by the invention of apparatus for screening fiber suspensions comprising a housing including an inlet for the fiber suspension, a reject outlet for removal of a reject portion of the fiber suspension, and an outlet for receipt of an accept portion of the fiber suspension, a screen member located within the housing, a rotor rotatably mounted in the screen member and forming a screening zone therebetween, the rotor including a plurality of pulsation wings mounted on the rotor, a reject chamber in the housing for collecting the reject portion of the fiber suspension which does not pass through the screen member and for supplying the reject portion to the reject outlet, and an accept chamber in the housing for collecting the accept portion of the fiber suspension which passes through the screen member and for supplying the accept portion to the outlet, each of the plurality of wing members including an inside face facing the rotor, an outside face facing the screen member, a leading edge facing the direction of rotation of the rotor, a trailing edge facing away from the direction of rotation of the rotor, an upper end and a lower portion including a lower end, the lower end facing the reject chamber, whereby a predetermined pressure difference is created between the outside face and the inside face of the at least one of the plurality of pulsation wings, the predetermined pressure difference decreasing in the lower portion of the at least one of the pulsation wings in the direction of the lower end thereof. In a preferred embodiment, the predetermined pressure difference is created between the outside face and the inside face of each of the plurality of pulsation wings, the predetermined pressure difference decreasing at the lower portion of the plurality of the pulsation wings in the direction of the lower ends thereof. Preferably, each of the plurality of pulsation wings includes a predetermined maximum extension in a tangential direction between the leading edge and the trailing edge, and wherein the lower portion of the plurality of pulsation wings where the predetermined pressure difference decreases comprises a predetermined axial portion of the plurality of the pulsation wings having a predetermined axial length comprising from about 0.5 to 2 times the predetermined maximum extension. In a preferred embodiment, the lower portion of the plurality of the pulsation wings where the predetermined pressure difference decreases comprises a predetermined axial portion of the plurality of the pulsation wings having a predetermined axial length comprising from about 1 to 1.5 times the predetermined maximum extension.

In accordance with one embodiment of the apparatus of the present invention, each of the plurality of the pulsation wings includes an extension in the tangential direction between the leading edge and the trailing edge, and wherein the extension gradually decreases at the lower portion of the plurality of the pulsation wings. In a preferred embodiment, the gradual decrease in the extension at the lower portion of the plurality of the pulsation wings comprises a reduction from the trailing edge of the plurality of the pulsation wings. More preferably, the plurality of the pulsation wings includes a predetermined maximum extension in the tangential direction, and a predetermined minimum extension in the tangential direction at the lower end of the plurality of the pulsation wings, wherein the predetermined minimum extension is at least one-fifth of the predetermined maximum extension. Most preferably, the predetermined minimum extension is at least one-fourth of the predetermined maximum extension.

In accordance with the present invention, a rotor has also been invented which is adapted to be disposed in a screening apparatus including a housing and a screen member located within the housing, the rotor comprising a plurality of pulsation wings, each of the plurality of pulsation wings including an inside face facing the rotor, an outside face adapted to face a screen member, a leading edge adapted to face in the direction of rotation of the rotor, a trailing edge adapted to face against the direction of rotation of the rotor, an upper end and a lower portion including a lower end, whereby a predetermined pressure difference can be created between the outside face and the inside face of at least one of the plurality of pulsation wings, the predetermined pressure difference decreasing at the lower portion of the at least one pulsation wing in the direction of the lower end thereof.

In a pulsation wing of conventional type, where the pressure difference between the inside and the outside is great even at the lower portion of the pulsation wing, a flow of pulp from the reject chamber to the outside of the pulsation wing is obtained. This is due to the fact that the edge of the pulsation wing toward the reject chamber, i.e. the lower edge, during rotation moves against a suspension which, on a relative basis, is essentially standing still in the reject chamber. This means physically that a flow from the reject chamber is more favorable than that in which the pulp flows over the lower edge of the pulsation wing from its inside to its outside, or through the screening means to the outside of the pulsation wing. The flow of pulp from the reject chamber to the screening zone contributes to a considerably deteriorated efficiency and capacity of the screening device, because this contributes strongly to a higher pulp concentration in the lower portion of the screening zone. The flow of pulp from the reject chamber to the screening zone also counteracts the downfeed of reject along the screening means to the reject chamber.

With a pulsation wing formed according to the present invention a substantially reduced flow of pulp from the reject chamber to the screening zone is obtained, compared to a conventional screening device.

The present invention also relates to a rotor for use in a screening device of the aforesaid kind.

BRIEF DESCRIPTION OF THE DRAWINGS

The present invention is described in greater detail in the following detailed description, which refers to the accompanying drawings illustrating an embodiment of the present invention.

DETAILED DESCRIPTION

Figure 1:
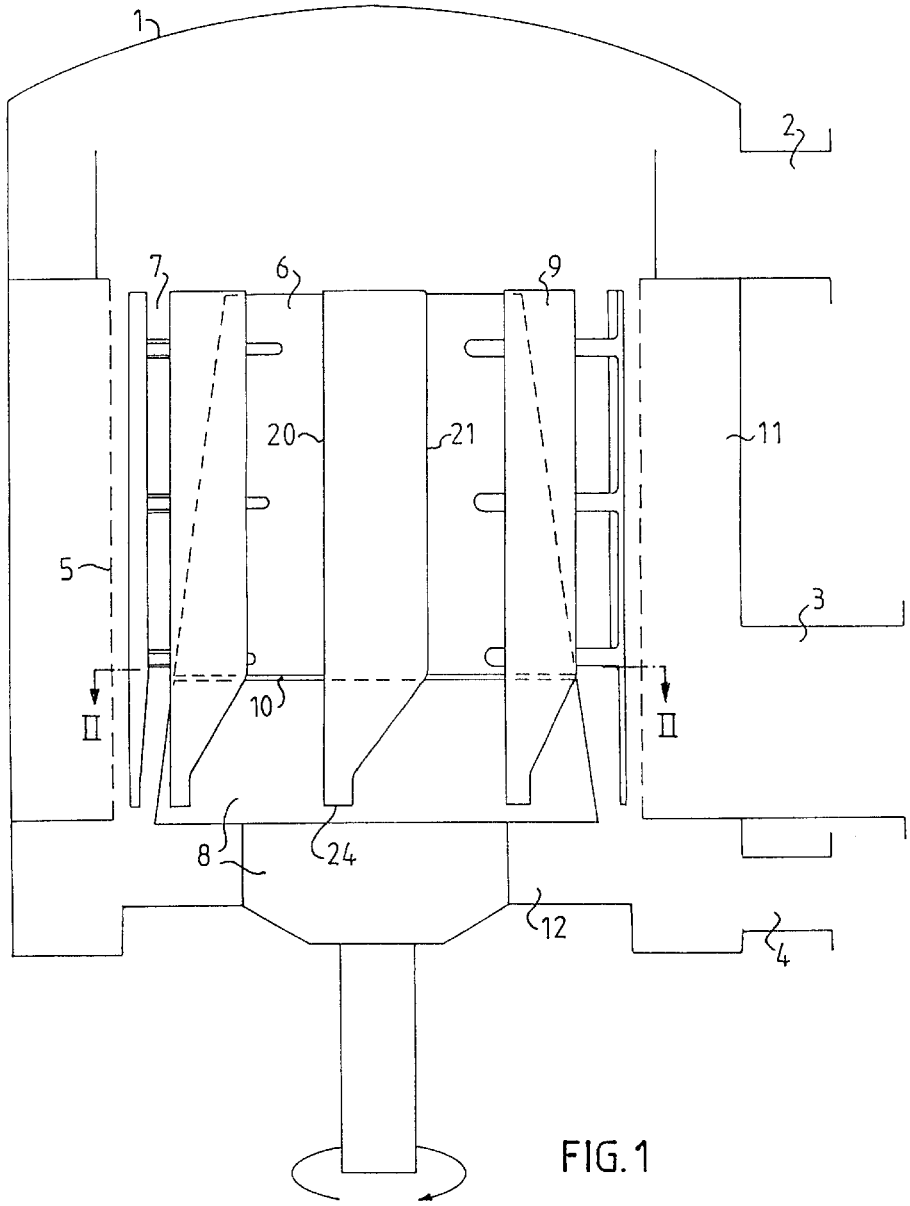
FIG. 1 is a side, elevational, schematic representation of a screening device according to the present invention.
Figure 2:
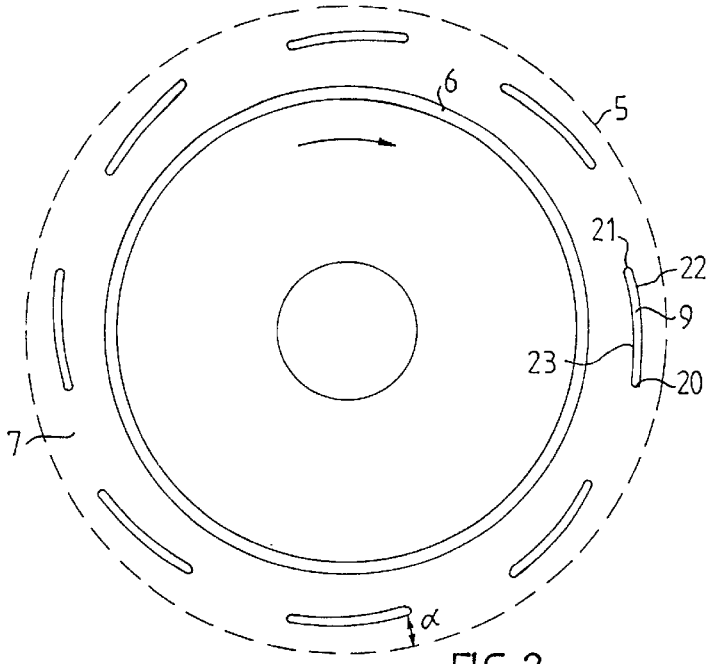
FIG. 2 is a top, elevational, cross-sectional view of the screening device shown in FIG. 1, taken along line II—II in FIG. 1.

The screening device shown in FIG. 1 comprises a pressurized housing 1 with inlet 2 for pulp (inject) and outlets 3 and 4, for accept and reject, respectively. In the housing 1 is located a stationary, rotation-symmetrical screening means 5, preferably with a vertical symmetry axis. In the screening means 5 a rotary rotor 6 is located. The rotor 6 is concentric with the screening means 5 and formed as a truncated cone, but can also be formed as a cylinder. The rotor 6 is, at one end, located adjacent a stationary dilution chamber 8. An overall screening zone 7 is formed between the screening means 5 and the rotor 6, and the dilution chamber 8, i.e. along the entire screening means 5. Between the dilution chamber 8 and rotor 6 a dilution gap 10 allows the supply of dilution liquid to the screening zone 7.

The inject inlet 2 for the pulp is connected to the housing 1 for the supply of pulp to the upper end of the screening zone 7. The pulp flows thereafter down through the screening zone 7, and the accept fraction flows through the screening means 5, and by means of an accept chamber 11 located outside the screening means 5 out through the accept outlet 3. The reject fraction flows, at the end of the screening zone 7, out into a reject chamber 12 located outside the lower portion of the dilution chamber 8 and out through the reject outlet 4.

The rotor 6 is, on its outside, provided with pulsation wings 9 which are distributed in the circumferential direction. The wings 9 extend axially along the entire screening zone 7 and have a lower edge 24 toward the reject chamber 12. These wings 9 are placed at a distance from the rotor 6 and are formed with a leading edge 20 located near the screening means 5 and a rear edge 21 located at a greater distance from the screening means 5. The wings 9 thus produce a suction pulse when they move along the screening means 5, which pulse keeps the screening means 5 open and promotes the separation of the accept.

Every pulsation wing 9 is, at the end of the screening zone 7, i.e. on the lower portion of the pulsation wing, formed in such a way that the pressure difference between its outside 22 (facing the screening means 5) and its inside 23 (facing the rotor 6) during operation substantially decreases gradually in the direction towards the reject chamber 12. This is achieved by means of the area of the pulsation wing 9 substantially decreasing gradually in the direction towards its lower edge 24, in that the extension of the pulsation wing 9 in the tangential direction substantially decreases gradually in the lower portion of the pulsation wing 9 in the direction towards the lower edge 24, and where this decrease in extension is made from the rear edge 21 of the pulsation wing 9. The pulsation wing 9, however, should along its entire length have a certain extension in the tangential direction, in order to ensure that a certain suction pulse and energy input is obtained. The leading edge of the pulsation wing 9 should be at the same distance from the screening means 5 along the entire length of the pulsation wing. In the embodiment according to FIG. 1 the pulsation wing 9 is cut off at an angle of 45 degrees from its rear edge 21 in the direction towards the corner between the leading edge 20 and the lower edge 24, but not all the way to the corner. The reason for this is to ensure that a certain suction pulse is obtained also at the lowermost portion of the pulsation wing. In the embodiment shown, the extension in tangential direction of the pulsation wing 9 therefore does not decrease at the lowermost portion of the pulsation wing 9 and, thus, no additional reduction of the pressure difference between the outside 22 and inside 23 is obtained, other than that obtained due to edge effects. The pressure difference between the outside 22 and the inside 23 of the pulsation wing 9, however, is so small that no great flow of pulp from the reject chamber 12 to the screening zone 7 is obtained.

Figure 3:
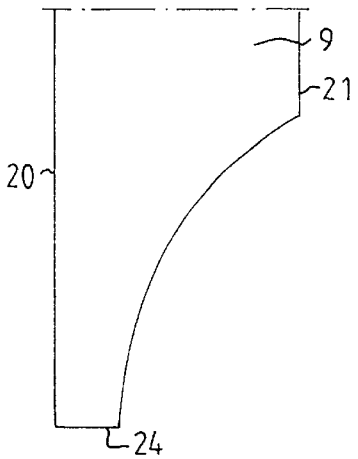
FIG. 3 is a side, elevational, partial view of an embodiment of the pulsation wing used in accordance with the present invention.
Figure 4:
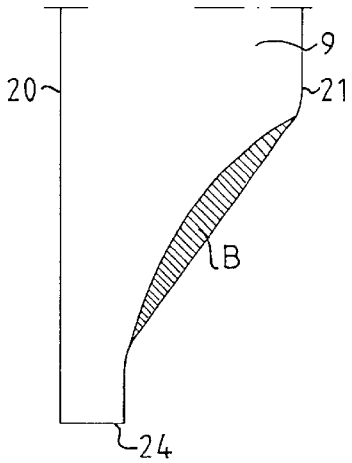
FIG. 4 is a side, elevational view of a comparison between two embodiments fo the pulsation wings used in accordance with the present invention.

In the embodiment according to FIG. 3 the pulsation wing 9 is cut off in a rounded manner. This embodiment, compared to the embodiment shown in FIG. 1, brings about a greater reduction of the area of the pulsation wing 9 in its lower portion and, thus, a more favorable decrease in the pressure difference. The difference in reduced area is shown by the dashed area B in FIG. 4.

The lower portion of the pulsation wing 9, i.e. the portion where the extension in the tangential direction substantially decreases gradually, extends starting from the lower edge 24 of the pulsation wing in the axial direction corresponding to about 0.5 to 2 times, but suitably to from about 1 to 1.5 times the greatest extension of the pulsation wing 9 in the tangential direction. The pulsation wing 9, in order to generate a suction pulse along the entire length of the screening means 5, should have a smallest extension in the tangential direction of at least about ⅕, but suitably at least about ¼ of the greatest extension of the pulsation wing 9 in the tangential direction.

A pulsation wing can also be formed so that its extension in the tangential direction at the lowermost portion of the pulsation wing approaches zero. In this manner, energy input to the pulp, but almost no suction pulse, is obtained. There is, however, the risk that the lowermost portion of the screening means can get clogged, with resulting deteriorated capacity of the screening device.

The pressure difference between the inside and the outside of the pulsation wing at the end of the screening zone can also be decreased, for example, in that the angle of incidence of the pulsation wing to the screening means is reduced in the lower portion of the screening zone in the direction to the lower edge of the pulsation wing. This can be achieved, for example, by a turned wing. The pressure difference can also be reduced by a combination of decreasing the angle of incidence and reducing the area in the direction to the lower edge of the pulsation wing.

At least one of the pulsation wings in the screening device should be formed according to the present invention, but in order to obtain a flow as small as possible from the reject chamber to the screening zone, all of the pulsation wings preferably should be formed so that the pressure difference between the inside and outside of the pulsation wing decreases at the lower portion of the screening zone.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for screening fiber suspensions comprising a housing including an inlet for said fiber suspension, a reject outlet for removal of a reject portion of said fiber suspension, and an outlet for receipt of an accept portion of said fiber suspension, a screen member located within said housing, a rotor rotatably mounted in said screen member and forming a screening zone therebetween, said rotor including a plurality of pulsation wings mounted on said rotor, a reject chamber in said housing for collecting said reject portion of said fiber suspension which does not pass through said screen member and for supplying said reject portion to said reject outlet, and an accept chamber in said housing for collecting said accept portion of said fiber suspension which passes through said screen member and for supplying said accept portion to said outlet, each of said plurality of pulsation wings including an inside face facing said rotor, an outside face facing said screen member, a leading edge facing the direction of rotation of said rotor, a trailing edge facing away from the direction of rotation of said rotor, an upper end and a lower portion including a lower end, said lower end facing said reject chamber, whereby a predetermined pressure difference is created between said outside face and said inside face of said at least one of said plurality of pulsation wings, said predetermined pressure difference decreasing at said lower portion of said at least one of said pulsation wings in the direction of said lower end thereof.

2. The apparatus of claim 1 wherein said predetermined pressure difference is created between said outside face and said inside face of each of said plurality of pulsation wings, said predetermined pressure difference decreasing at said lower portion of said plurality of said pulsation wings in the direction of said lower ends thereof.

3. The apparatus of claim 2 wherein each of said plurality of pulsation wings includes a predetermined maximum extension in a tangential direction between said leading edge and said trailing edge, and wherein said lower portion of said plurality of pulsation wings where said predetermined pressure difference decreases comprises a predetermined axial portion of said plurality of said pulsation wings having a predetermined axial length comprising from about 0.5 to 2 times said predetermined maximum extension.

4. The apparatus of claim 3 wherein said lower portion of said plurality of said pulsation wings where said predetermined pressure difference decreases comprises a predetermined axial portion of said plurality of said pulsation wings having a predetermined axial length comprising from about 1 to 1.5 times said predetermined maximum extension.

5. The apparatus of claim 1 wherein each of said plurality of said pulsation wings includes an extension in the tangential direction between said leading edge and said trailing edge, and wherein said extension gradually decreases at said lower portion of said plurality of said pulsation wings.

6. The apparatus of claim 5 wherein said gradual decrease in said extension at said lower portion of said plurality of said pulsation wings comprises a reduction from said trailing edge of said plurality of said pulsation wings.

7. The apparatus of claim 6 wherein said plurality of said pulsation wings includes a predetermined maximum extension in the tangential direction, and a predetermined minimum extension in said tangential direction at said lower end of said plurality of said pulsation wings, wherein said predetermined minimum extension is at least one-fifth of said predetermined maximum extension.

8. The apparatus of claim 7 wherein said predetermined minimum extension is at least one-fourth of said predetermined maximum extension.

9. A rotor adapted to be disposed in a screening apparatus including a housing and a screen member located within said housing, said rotor comprising a plurality of pulsation wings, each of said plurality of pulsation wings including an inside face facing said rotor, an outside face adapted to face a screen member, a leading edge adapted to face in the direction of rotation of said rotor, a trailing edge adapted to face against said direction of rotation of said rotor, an upper end and a lower portion including a lower end, whereby a predetermined pressure difference can be created between said outside face and said inside face of at least one of said plurality of pulsation wings, said predetermined pressure difference decreasing at said lower portion of said at least one pulsation wing in the direction of said lower end thereof.

* * * * *